US011007798B2

(12) United States Patent
Fujisawa

(10) Patent No.: US 11,007,798 B2
(45) Date of Patent: May 18, 2021

(54) PRINTING APPARATUS

(71) Applicant: SEIKO EPSON CORPORATION, Tokyo (JP)

(72) Inventor: Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/795,934

(22) Filed: Feb. 20, 2020

(65) Prior Publication Data

US 2020/0269606 A1 Aug. 27, 2020

(30) Foreign Application Priority Data

Feb. 22, 2019 (JP) ..... JP2019-030238

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

2016/0167399 A1 6/2016 Ohnishi
2017/0313100 A1* 11/2017 Hori ..... B41M 7/0081

FOREIGN PATENT DOCUMENTS

JP 2007-203624 A 8/2007
JP 2015-009376 A 1/2015
JP 2017-196795 A 11/2017

* cited by examiner

*Primary Examiner* — Bradley W Thies
(74) *Attorney, Agent, or Firm* — Workman Nydegger

(57) ABSTRACT

A printing apparatus includes a support member having a curved surface, an ejection head, a housing, a light emitting section, a first light-shielding plate arranged between the ejection head and the irradiation section, and a second light-shielding plate arranged between the first light-shielding plate and the ejection head. The housing is arranged in a position far from the curved surface with respect to a virtual tangent plane that passes through a portion of the nozzle surface being farthest from the irradiation port and is held in contact with a lower end of the first light-shielding plate. The second light-shielding plate is arranged in a position that allows the second light-shielding plate to block at least part of light entering a side surface orthogonal to the nozzle surface of the ejection head among the light that is emitted from the irradiation section.

4 Claims, 9 Drawing Sheets

PRINTING APPARATUS

The present application is based on, and claims priority from JP Application Serial Number 2019-030238, filed Feb. 22, 2019, the disclosure of which is hereby incorporated by reference herein in its entirety.

BACKGROUND

1. Technical Field

The disclosure relates to a printing apparatus.

2. Related Art

For example, as described in JP-A-2017-196795, there has been hitherto known a printing apparatus including ejection heads that eject a liquid onto a recording medium supported by a support member and prints an image on the recording medium and an irradiation section that irradiates the medium with light for curing the liquid applied on the medium. An inclination part is provided at an irradiation port of the irradiation section. An interval between the inclination part and the support member is reduced as approaching to the ejection heads. The inclination part reduces an amount of the light emitted from the irradiation section, which enters nozzle surfaces to which the ejection heads eject the liquid, and suppresses curing of the liquid on the nozzle surfaces of the ejection heads.

However, it has been confirmed that ink being the liquid adhering to the nozzle surface of each ejection head is cured by a slight amount of leaking light when printing continues for a long time even by adopting the configuration of the printing apparatus described above. Further, it has been confirmed that ink adhering to side surfaces of the ejection heads are also cured. The ink adhering to the side surfaces of the ejection heads are considered as ink mist generated at the time of ejection of the ink. In this case, for example, there is a problem of unstable ejection of the ink when the ink cured on the side surfaces of the ejection heads is wiped off from the ejection heads during maintenance, moves, and adheres to the nozzle surfaces.

SUMMARY

A printing apparatus according to the present application includes a support member configured to support, with a curved surface thereof, a recording medium conveyed in a predetermined conveyance direction, an ejection head configured to eject a liquid from a nozzle of a nozzle surface arranged at a position facing the support member to print an image on the recording medium supported by the curved surface, an irradiation section including a housing and a light emitting section configured to emit light for curing the liquid, the light emitting section accommodated inside the housing, the irradiation section configured to irradiate the recording medium supported by the curved surface with the light emitted from the light emitting section through an irradiation port defined by the housing, a first light-shielding plate arranged between the ejection head and the irradiation section in the conveyance direction, and a second light-shielding plate arranged between the first light-shielding plate and the ejection head in the conveyance direction, wherein the housing is arranged in a position far from the curved surface with respect to a virtual tangent plane that passes through a portion, farthest from the irradiation port, of the nozzle surface and is in contact with a lower end of the first light-shielding plate, and the second light-shielding plate is arranged in a position that allows the second light-shielding plate to block at least part of light entering a side surface orthogonal to the nozzle surface of the ejection head among the light that is emitted from the irradiation section and regularly reflected or scattered on the support member or the recording medium supported by the support member, and is arranged in a position so that a distance between a lower end of the second light-shielding plate and the curved surface is equal to or more than a height of the nozzle surface from the curved surface.

In the printing apparatus, an interval between the second light-shielding plate and the curved surface may be the same as an interval between the ejection head and the curved surface.

In the printing apparatus, the first light-shielding plate and the second light-shielding plate may be integrally formed.

In the printing apparatus, the ejection head may be a first ejection head arranged upstream of the irradiation section in the conveyance direction, the first light-shielding plate may be a first upstream light-shielding plate arranged upstream of the irradiation section in the conveyance direction, the second light-shielding plate may be a second upstream light-shielding plate arranged upstream of the first upstream light-shielding plate in the conveyance direction, the virtual tangent plane may be a first virtual tangent plane that passes through a position, farthest from the irradiation port, of the nozzle surface of the first ejection head and is in contact with a lower end of the first light-shielding plate, the printing apparatus may further include a first downstream light-shielding plate arranged downstream of the irradiation section in the conveyance direction, a second ejection head arranged downstream of the first downstream light-shielding plate in the conveyance direction, and a second downstream light-shielding plate arranged between the first downstream light-shielding plate and the second ejection head in the conveyance direction, the housing may be arranged in a position far from the curved surface with respect to a second virtual tangent plane that passes through a portion, farthest from the irradiation port, of the nozzle surface of the second ejection head and is held in contact with a lower end of the first downstream light-shielding plate, and the second downstream light-shielding plate may be arranged in a position that allows the second light-shielding plate to block at least part of light entering a side surface orthogonal to the nozzle surface of the second ejection head among the light that is emitted from the irradiation section and regularly reflected or scattered, and is arranged in a position so that a distance between a lower end of the second downstream light-shielding plate and the curved surface is equal to or more than a height of the nozzle surface from the curved surface.

DESCRIPTION OF EXEMPLARY EMBODIMENTS

Exemplary embodiments of the present disclosure will be described below with reference to the accompanying drawings. Note that, in each of the drawings below, to illustrate each of members and the like in a recognizable size, each of the members and the like is illustrated to a scale different from an actual scale.

1. First Exemplary Embodiment

Figure 1:
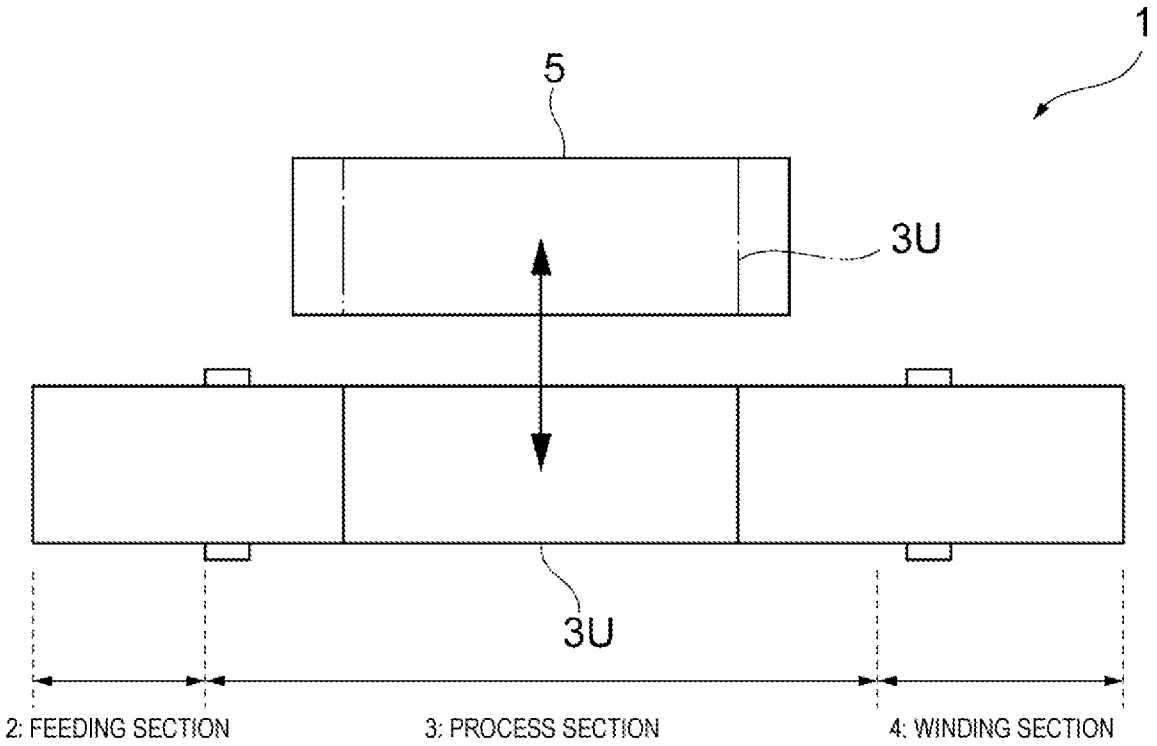
FIG. 1 is a plan view illustrating a layout of a printing apparatus according to a first exemplary embodiment.
Figure 1:
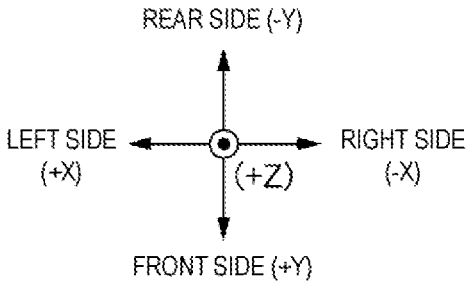

FIG. 1 is a plan view illustrating a layout of a printing apparatus 1, and is a view of the printing apparatus 1 seen in a +Z direction. Further, FIG. 2 is a schematic view illustrating a configuration of the printing apparatus 1, and is a view of the printing apparatus 1 seen in a +Y direction.

As illustrated in FIG. 1, in the printing apparatus 1, a feeding section 2, a process section 3, and a winding section 4 are arrayed from a +X direction to a −X direction. Further, a maintenance section 5 is arranged on a −Y direction side of the process section 3, and a process unit 3U of the process section 3 is movable integrally with the maintenance section 5.

Figure 2:
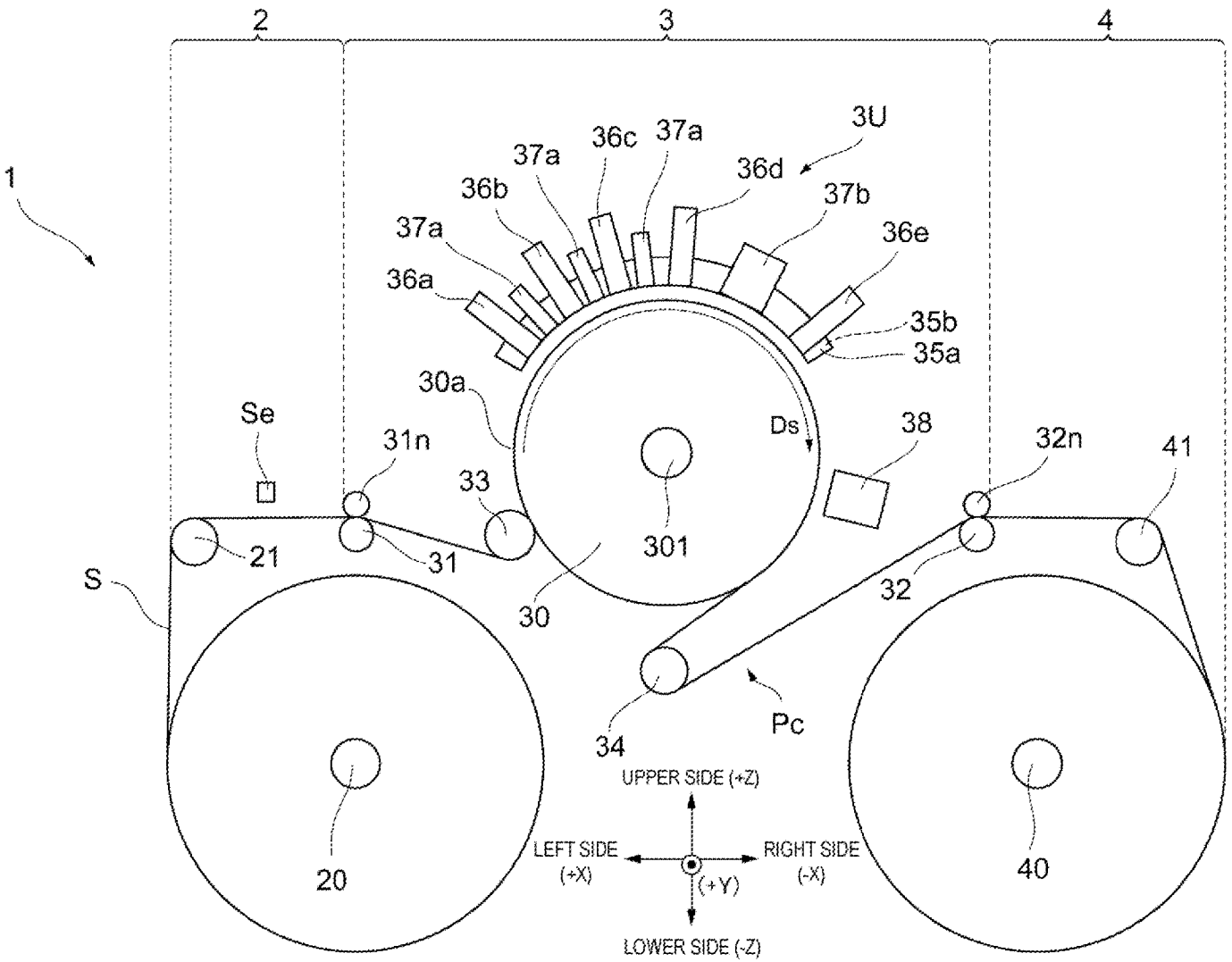
FIG. 2 is a schematic view illustrating a configuration of the printing apparatus according to the first exemplary embodiment.

As illustrated in FIG. 2, the feeding section 2 and the winding section 4 respectively include a feeding shaft 20 and a winding shaft 40 in the printing apparatus 1. Further, both edges of a sheet S being a recording medium are wound by the feeding section 2 and the winding section 4 in a roll form, and stretched therebetween. The sheet S is conveyed from the feeding section 2 to the process section 3 along a path Pc in which the sheet S is stretched in such a manner, subjected to printing processing by the process unit 3U, and then conveyed to the winding section 4. Types of the sheet S in the present exemplary embodiment are broadly classified into a paper-based type and a film-based type. To give specific examples, the paper-based type includes woodfree paper, cast paper, art paper, coated paper, and the like, and the film-based type includes synthetic paper, Polyethylene terephthalate (PET), polypropylene (PP), and the like. Note that in the following description, of both surfaces of the sheet S, the surface on which the image is recorded will be referred to as a front surface and the reverse side surface of the front surface will be referred to as a back surface.

The feeding section 2 includes the feeding shaft 20 around which an edge of the sheet S is wound, and a driven roller 21 on which the sheet S drawn out from the feeding shaft 20 is wound. The feeding shaft 20 supports the sheet S by winding the edge of the sheet S around the feeding shaft 20 with the front surface of the sheet S facing outward. In addition, when the feeding shaft 20 is rotated clockwise in FIG. 2, the sheet S wound around the feeding shaft 20 is fed to the process section 3 via the driven roller 21. The sheet S is wound around the feeding shaft 20 via a core pipe (not illustrated) that is detachable from the feeding shaft 20. Thus, when the sheet S around the feeding shaft 20 is used up, the sheet S around the feeding shaft 20 can be replaced by attaching, to the feeding shaft 20, a new core pipe around which the rolled sheet S is wound. An edge sensor Se that detects an edge of the sheet S in a width direction between the driven roller 21 and a front driving roller 31 is arranged.

While supporting the sheet S fed from the feeding section 2 by a front surface 30*a* (also referred to as a curved surface 30*a*) of a platen drum 30 being a support member, the process section 3 prints an image on the sheet S by performing processing as appropriate with the process unit 3U arranged along the front surface 30*a* of the platen drum 30. In the process section 3, the front driving roller 31 and a rear driving roller 32 are provided on both sides of the platen drum 30. The sheet S conveyed from the front driving roller 31 to the rear driving roller 32 is supported by the platen drum 30, and subjected to image printing.

The front driving roller 31 has a plurality of minute protrusions formed on the outer circumferential surface thereof by thermal spraying, and winds, from the back surface side, the sheet S fed from the feeding section 2. In addition, the front driving roller 31 is rotated clockwise in the drawing sheet of FIG. 2, and conveys the sheet S fed from the feeding section 2 downstream in a conveyance path. Note that a nip roller 31*n* is provided with respect to the front driving roller 31. The nip roller 31*n* abuts against the front surface of the sheet S while being biased toward the front driving roller 31, and sandwiches the sheet S together with the front driving roller 31. With this, a frictional force can be secured between the front driving roller 31 and the sheet S, and the front driving roller 31 can reliably perform conveyance of the sheet S.

The platen drum 30 is a cylindrical drum supported rotatably around a rotary shaft 301 extending in the +Y direction and the −Y direction by a support mechanism (not illustrated), and winds the sheet S conveyed from the front driving roller 31 to the rear driving roller 32 from the back surface side. The platen drum 30 supports the sheet S by the front surface (curved surface) 30*a* of the platen drum 30 from the back surface side of the sheet S while being driven to rotate in a conveyance direction Ds of the sheet S by receiving a frictional force between the platen drum 30 and the sheet S. The process section 3 is provided with driven rollers 33 and 34 that fold back the sheet S on both sides of the part at which the sheet S is wound on the platen drum 30. Of these driven rollers, the front surface of the sheet S is wound on the driven roller 33 between the front driving roller 31 and the platen drum 30 to fold back the sheet S. Meanwhile, the front surface of the sheet S is wound on the driven roller 34 between the platen drum 30 and the rear driving roller 32 to fold back the sheet S. In this way, by folding back the sheet S upstream and downstream of the platen drum 30 in the conveyance direction Ds, the long part at which the sheet S is wound on the platen drum 30 can be secured.

The rear driving roller 32 has a plurality of minute protrusions formed on the outer circumferential surface thereof by thermal spraying, and winds, from the back surface side, the sheet S conveyed from the platen drum 30 via the driven roller 34. In addition, the front driving roller 32 is rotated clockwise in the drawing sheet of FIG. 2, and conveys the sheet S to the winding section 4. Note that a nip roller 32*n* is provided with respect to the rear driving roller 32. This nip roller 32*n* abuts against the front surface of the sheet S while being biased toward the rear driving roller 32, and sandwiches the sheet S together with the rear driving roller 32. With this, a frictional force can be secured between the rear driving roller 32 and the sheet S, and the rear driving roller 32 can reliably perform conveyance of the sheet S.

In this way, the sheet S conveyed from the front driving roller 31 to the rear driving roller 32 is supported by the front surface 30*a* of the platen drum 30. In addition, in the process section 3, in order to print a color image on the front surface of the sheet S supported by the platen drum 30, the process unit 3U is provided. The process unit 3U includes a front plate 35*a* and a rear plate 35*b* that are paired on the front side and the rear side, respectively. The plates 35*a* and 35*b* each have an arc shape along the front surface 30*a* of the platen drum 30, and constitute a unit frame by being coupled to each other by a coupling member (not illustrated). In addition, ejection heads 36*a* to 36*e*, UV lamps 37*a* and 37*b*, and head movement mechanisms, and the like that are structural elements of the process unit 3U are attached to the unit frame as described below.

The four ejection heads 36*a* to 36*d* corresponding to yellow, cyan, magenta, and black are aligned in the conveyance direction Ds in the stated color order. More specifically, these four ejection heads 36*a* to 36*d* are oriented to the platen drum 30, and arranged radially from the rotary shaft 301 of the platen drum 30. Further, the two ejection heads 36*a* and 36*b* arranged upstream in the conveyance direction Ds among the ejection heads 36*a* to 36*d* are moved by one head movement mechanism, and positioned with respect to the sheet S wound on the platen drum 30. Further, the two ejection heads 36*c* and 36*d* arranged downstream are moved by another head movement mechanism, and positioned with respect to the sheet S wound on the platen drum 30. Further, these two head movement mechanisms move and position the four ejection heads 36*a* to 36*d*. With this, a distance between a nozzle tip (an ejection port of ink) of a nozzle surface 39 (FIG. 3) of each of the ejection heads 36*a* to 36*d* and the sheet S, namely, a paper gap can be set to an appropriate value. In this way, each of the ejection heads 36*a* to 36*d* ejects ink onto the sheet S wound on an outer circumferential part of the platen drum 30 while the paper gap is adjusted, and thus a color image is formed on the front surface of the sheet S.

Note that, in the ejection heads 36*a* to 36*e* in the present exemplary embodiment, a plurality of unit heads are arrayed in two rows in a staggered pattern in the +Y direction and the −Y direction orthogonal to the conveyance direction Ds. In each of the plurality of unit heads, a plurality of nozzles aligned in the +Y direction and the −Y direction are open. In this way, the nozzle surface 39 of each of the ejection heads 36*a* to 36*e* is provided with the plurality of nozzles in the +Y direction and the −Y direction.

As a liquid such as an ink and a recording liquid used in the ejection heads 36*a* to 36*d*, an ultraviolet (UV) ink (photocurable ink), which is cured by being irradiated with ultraviolet rays (light), is used. Thus, in order to cure and fix the ink onto the sheet S, the process unit 3U is provided with the UV lamps 37*a* and 37*b* being irradiation sections. Note that, the ink curing is performed at two separate stages of temporary curing and final curing. The UV lamps 37*a* for temporary curing are each arranged between the plurality of corresponding ejection heads 36*a* to 36*d*. In other words, the UV lamps 37*a* are used for curing (performing temporary curing of) the ink to such a degree that the ink does not lose its shape by emitting relatively weak ultraviolet rays, and are not used for completely curing the ink. Meanwhile, the UV lamp 37*b* for final curing is provided downstream of the plurality of ejection heads 36*a* to 36*d* in the conveyance direction Ds. Specifically, the UV lamp 37*b* is used for completely curing (performing final curing of) the ink by emitting ultraviolet rays stronger than those of the UV lamps 37*a*. By performing temporary curing and final curing as described above, the color image formed by the plurality of ejection heads 36*a* to 36*d* can be fixed onto the front surface of the sheet S.

Furthermore, the ejection head 36*e* is provided downstream of the UV lamp 37*b* in the conveyance direction Ds. The ejection head 36*e* faces the front surface of the sheet S wound on the platen drum 30 with slight clearance, and ejects a clear UV ink onto the front surface of the sheet S by an ink jet method. Specifically, the clear ink is further ejected onto the color image formed by the ejection heads 36*a* to 36*d* in four colors. Note that, a proper value is set to a paper gap of the ejection head 36*e* by moving and positioning the ejection head 36*e* alone by another head movement mechanism different from the head movement mechanisms that have been already described.

In this way, the ejection heads 36*a* to 36*e*, the UV lamps 37*a* and 37*b*, and the head movement mechanisms are attached to the unit frame and constitute the process unit 3U. When a normal operation, namely, printing processing is performed, the process unit 3U is positioned between the feeding section 2 and the winding section 4 as indicated by solid lines in FIG. 1. Meanwhile, when a maintenance operation of the process unit 3U, such as wiping processing and capping processing performed on the ejection heads 36*a* to 36*e*, is performed, the process unit 3U is moved to the maintenance section 5 by a slide driving mechanism (not illustrated) as indicated by dot-and-dash lines in FIG. 1.

In the process section 3, a UV lamp 38 is provided downstream of the ejection head 36*e* in the conveyance direction Ds. The UV lamp 38 is used for completely curing (performing final curing of) the clear ink ejected by the ejection head 36*e* by emitting strong ultraviolet rays. With this, the clear ink can be fixed onto the front surface of the sheet S.

The sheet S on which the color image is formed by the process section 3 is conveyed to the winding section 4 by the rear driving roller 32. In addition to the winding shaft 40 around which the edge of the sheet S is wound, the winding section 4 includes a driven roller 41 for winding, from the back surface side, the sheet S between the winding shaft 40 and the rear driving roller 32. The winding shaft 40 supports the sheet S by winding the edge of the sheet S around the winding shaft 40 with the front surface of the sheet S facing outward. Specifically, when the winding shaft 40 is rotated clockwise in the drawing sheet of FIG. 2, the sheet S conveyed from the rear driving roller 32 is wound around the winding shaft 40 via the driven roller 41. Note that, the sheet S is wound around the winding shaft 40 via a core pipe (not illustrated) that is detachable from the winding shaft 40. Thus, when the sheet S wound around the winding shaft 40 becomes full, the sheet S can be detached together with the core pipe.

Figure 3:
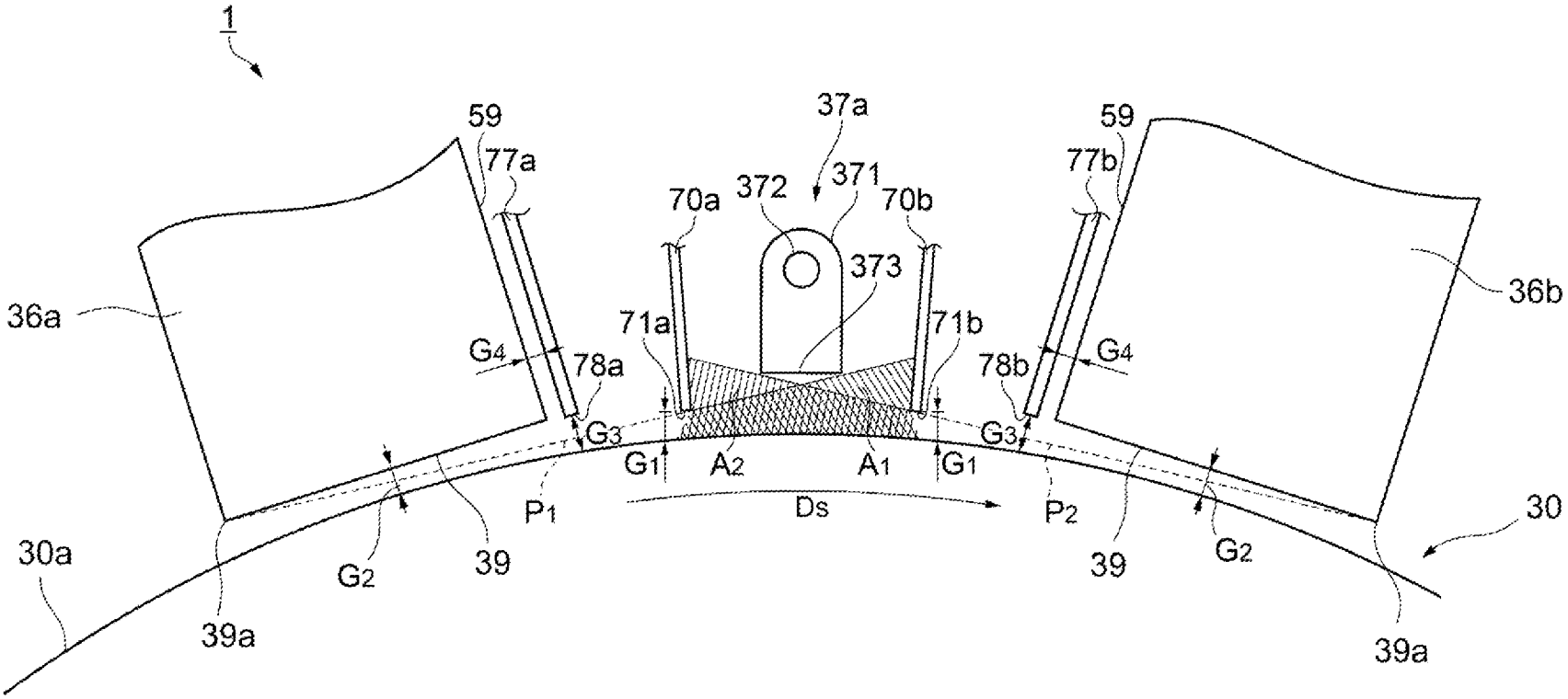
FIG. 3 is a view illustrating configuration of a UV lamp and a positional relationship between ejection heads and the UV lamp in the first exemplary embodiment.

Next, a configuration of the UV lamp 37*a* will be described, and a positional relationship between the ejection heads 36*a* and 36*b* and the UV lamp 37*a* will also be described. FIG. 3 is a view illustrating the configuration of the UV lamp 37*a* and a positional relationship between the ejection heads 36*a* and 36*b* and the UV lamp 37*a*.

As illustrated in FIG. 3, the UV lamp 37*a* includes a housing 371 and a light emitting section 372 that is accommodated inside the housing 371 and emits light (UV light) for curing the liquid, and is configured to irradiate the sheet S supported by the curved surface 30*a* of the platen drum 30 with the UV light emitted from the light emitting section 372 through an irradiation port 373 defined by the housing 371. As the light emitting section 372, an LED, a metal halide lamp, a xenon lamp, a carbon arc lamp, a chemical lamp, a low-pressure mercury lamp, a high-pressure mercury lamp, and the like may be used.

Further, in the present exemplary embodiment, a first upstream light-shielding plate 70*a* being a first light-shielding plate is arranged between the ejection head 36*a* being a first ejection head, which is arranged upstream of the UV lamp 37*a*, and the UV lamp 37*a* in the conveyance direction Ds of the sheet S. Further, a second upstream light-shielding plate 77*a* being a second light-shielding plate is arranged between the first upstream light-shielding plate 70*a* and the ejection head 36*a* in the conveyance direction Ds of the sheet S.

Further, a first downstream light-shielding plate 70*b* is arranged downstream of the UV lamp 37*a* in the conveyance direction Ds of the sheet S. Further, the ejection head 36*b* being a second ejection head is arranged downstream of the first downstream light-shielding plate 70*b* in the conveyance direction Ds of the sheet S. Further, a second downstream light-shielding plate 77*b* is arranged between the first downstream light-shielding plate 70*b* and the ejection head 36*b*. Thus, along the conveyance direction Ds of the sheet S, the ejection head 36*a*, the second upstream light-shielding plate 77*a*, the first upstream light-shielding plate 70*a*, the UV lamp 37*a*, the first downstream light-shielding plate 70*b*, the second downstream light-shielding plate 77*b*, and the ejection head 36*b* are arranged in the stated order.

The first upstream light-shielding plate 70*a* and the first downstream light-shielding plate 70*b* are plate-shaped members that prevent the UV light emitted through the irradiation port 373 of the UV lamp 37*a* from entering the nozzle surfaces 39 of the ejection heads 36*a* and 36*b*. In the present exemplary embodiment, the first upstream light-shielding plate 70*a* and the first downstream light-shielding plate 70*b* are arranged by being fixed to a frame for supporting the housing 371. Further, as illustrated in FIG. 3, a gap G1 between each of the first upstream light-shielding plate 70*a* and the first downstream light-shielding plate 70*b*, and the front surface 30*a* of the platen drum 30 is set to be wider than a gap G2 between each of the nozzle surfaces 39 the ejection heads 36*a* and 36*b*, and the front surface 30*a* of the platen drum 30. With this, the first upstream light-shielding plate 70*a* and the first downstream light-shielding plate 70*b* can be prevented from being held in contact with the sheet S supported by the surface 30*a* of the platen drum 30. As a result, damage to the sheet S can be prevented.

Note that, on a liner virtual line connecting one end of the first upstream light-shielding plate 70*a* and the center of the rotary shaft 301 with each other, the gap G1 corresponds to a gap between the one end of the first upstream light-shielding plate 70*a* and a part the curved surface 30*a* that intersects with the virtual line. On a linear virtual line connecting the center of the nozzle surface 39 in the conveyance direction Ds and the center of the rotary shaft 301, the gap G2 corresponds to a gap between the center of the nozzle surface 39 in the conveyance direction Ds and a part of the curved surface 30*a* that intersects with the imaginary line. In other words, in FIG. 3, the gap G1 corresponds to the narrowest gap between the one end of the first upstream light-shielding plate 70*a* and the curved surface 30*a*. In FIG. 3, the gap G2 corresponds to the narrowest gap between the nozzle surface 39 and the curved surface 30*a*.

Herein, when the housing 371 of the UV lamp 37*a* is arranged inside a region A1 indicated by lines diagonally to the lower right in FIG. 3, light emitted from the light source 372 is reflected by the front surface 30*a* of the platen drum 30 or the front surface of the sheet S and becomes reflected light. The reflected light is scattered by shining on the housing 371 and becomes scattered light. The first upstream light-shielding plate 70*a* located upstream cannot prevent the scattered light from directly entering the ejection head 36*a* located upstream. Further, when the housing 371 of the UV lamp 37*a* is arranged inside a region A2 indicated by lines diagonally to the upper right in FIG. 3, the first downstream light-shielding plate 70*b* located downstream cannot prevent light scattered by shining on the housing 371 from directly entering the ejection head 36*b* located downstream.

Thus, in the exemplary embodiment, as illustrated in FIG. 3, the housing 371 of the UV lamp 37*a* is arranged in a position far from the front surface (curved surface) 30*a* of the platen drum 30 with respect to a first virtual tangent plane P1. The first virtual tangent plane P1 corresponds to a virtual tangent plane that passes through a portion 39*a* of the nozzle surface 39 of the ejection head 36*a* located upstream being farthest from the irradiation port 373 and that contacts a lower end 71*a* of the first upstream light-shielding plate 70*a*. The housing 371 of the UV lamp 37*a* is also arranged in a position far from the front surface 30*a* of the platen drum 30 with respect to a second virtual tangent plane) P2 that passes through a portion 39*a* of the nozzle surface 39 of the ejection head 36*b* located downstream being farthest from the irradiation port 373 and that is held in contact with a lower end 71*b* of the first downstream light-shielding plate 70*b*.

In this way, the housing 371 of the UV lamp 37*a* is arranged in the position far from the front surface 30*a* of the platen drum 30 with respect to the two planes, namely, the first virtual tangent plane P1 and the second virtual tangent plane P2. Thus, the first upstream light-shielding plate 70*a* and the first downstream light-shielding plate 70*b* can block the scattered light near the irradiation port 373 in the housing 371 from directly entering the nozzle surfaces 39, and part of light scattered by shining on the housing 371 can be prevented from directly entering the nozzle surfaces 39 of the ejection heads 36*a* and 36*b*.

Further, the second upstream light-shielding plate 77*a* and the second downstream light-shielding plate 77*b* are arranged in positions capable of blocking at least part of light entering side surfaces 59 orthogonal to the nozzle surfaces 39 of the ejection heads 36*a* and 36*b* among the UV light that is emitted by the UV lamp 37*a* and regularly reflected or scattered on the platen drum 30 or the sheet S supported by the platen drum 30, and are arranged in positions at which a gap G3 between each of lower ends 78*a* and 78*b* of the second upstream light-shielding plate 77*a* and the second downstream light-shielding plate 77*b* and the curved surface 30*a* is equal to or more than a height of the nozzle surfaces 39 from the curved surface 30*a* (the gap G2). In the present exemplary embodiment, the second upstream light-shielding plate 77*a* and the second downstream light-shielding plate 77*b* are plate-shaped members, and the second upstream light-shielding plate 77*a* and the second downstream light-shielding plate 77*b* are arrayed to face the side surfaces 59 of the ejection heads 36*a* and 36*b* facing the UV lamp 37*a*. In the present exemplary embodiment, the second upstream light-shielding plate 77*a* and the second downstream light-shielding plate 77*b* are arranged by being fixed to the frame for supporting the housing 371. Note that, on linear virtual lines connecting the lower ends 78*a* and 78*b* of the second upstream light-shielding plate 77*a* and the second downstream light-shielding plate 77*b* and the center of the rotary shaft 301, the gap G3 corresponds to a gap between each of the lower ends 78*a* and 78*b* of the second upstream light-shielding plate 77*a* and the second downstream light-shielding plate 77*b*, and the parts of the curved surface 30*a* that intersect with the virtual lines. In other words, in FIG. 3, the gap G3 corresponds to the narrowest gap between each of the lower ends 78*a* and 78*b* of the second upstream light-shielding plate 77*a* and the second downstream light-shielding plate 77*b*, and the curved surface 30*a*. Further, a distance dimension G4 between the second downstream light-shielding plate 77*b* and the side surface 59 of the ejection head 36*b* is set to such gap that the second downstream light-shielding plate 77*b* and the side surface 59 of the ejection head 36*b* are not held in contact with each other.

In the present exemplary embodiment, the gap G3 between each of the second upstream light-shielding plate 77*a* and the second downstream light-shielding plate 77*b*, and the curved surface 30*a* of the platen drum 30, (the gap G3) is the same as the gap G2 between the nozzle surface 39 of the ejection head 36*a* and the curved surface 30*a* of the platen drum 30 (the gap G2). With this, while preventing the second upstream light-shielding plate 77*a* and the second downstream light-shielding plate 77*b* from being held in contact with the sheet S supported by the curved surface 30*a* of the platen drum 30, the reflected light or the scattered light can be prevented from entering the side surfaces 59 of the ejection heads 36*a* and 36*b* as much as possible. Therefore, curing of ink adhering to the side surfaces 59 of the ejection heads 36*a* and 36*b*, which is caused by part of the scattered light entering the side surfaces 59 of the ejection heads 36*a* and 36*b*, can be prevented.

Note that, a positional relationship between the ejection heads 36*b* and 36*c*, and the UV lamp 37*a* arranged therebetween, a positional relationship between the ejection heads 36*c* and 36*d*, and the UV lamp 37*a* arranged therebetween, a positional relationship between the ejection heads 36*d* and 36*e*, and the UV lamp 37*b* arranged therebetween, and a positional relationship between the first upstream light-shielding plate 70*a* and the first downstream light shielding plate 70*b*, and the second upstream light-shielding plate 77*a* and the second downstream light-shielding plate 77*b* are substantially similar to the positional relationship between the ejection heads 36*a*, 36*b* and the UV lamp 37*a* arranged therebetween and the positional relationship between the first upstream light-shielding plate 70*a* and the first downstream light shielding plate 70*b*, and the second upstream light-shielding plate 77*a* and the second downstream light-shielding plate 77*b* that have already been described. Thus, detailed description therefor is omitted.

Figure 4:
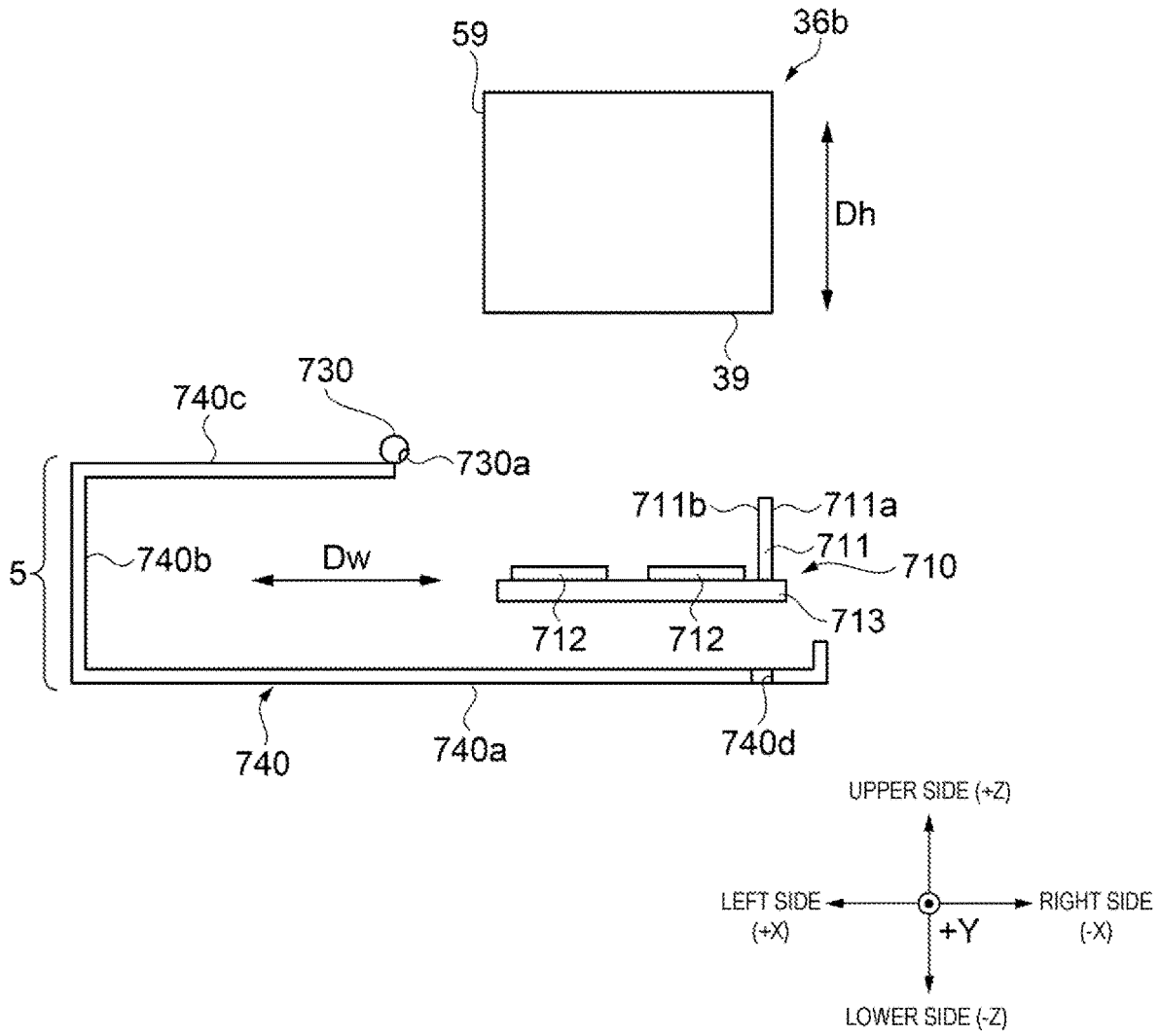
FIG. 4 is a schematic view illustrating a configuration of a maintenance section in the first exemplary embodiment.

Next, a configuration of the maintenance section 5 will be described. FIG. 4 is a schematic view illustrating the configuration of the maintenance section 5. The maintenance section 5 is provided with a wiper 711 being a wiping portion. The wiper 711 prevents clogging of the nozzle and removes stains or the like on the nozzle surface 39 by wiping processing for wiping each of the nozzle surfaces 39 of the ejection heads 36*a* to 36*e*.

As illustrated in FIG. 4, one maintenance section 5 is provided to each of the ejection heads 36*a* to 36*e*. Note that, in FIG. 4, as one example, the maintenance section 5 corresponding to the ejection head 36*b* is given. The maintenance section 5 is provided adjacent to the platen drum 30. The ejection head 36*b* is configured to be movable by a drive motor in the +Y direction and the −Y direction between a printing position on the platen drum 30 and a maintenance position on the maintenance section 5. Further, the ejection head 36*b* is configured to be movable by the drive motor at the maintenance position in a retreating direction Dh orthogonal to the nozzle surface 39 so as to be positioned at a cleaning position close to the maintenance section 5 and a retracting position away from the maintenance section 5. Note that, the second upstream light-shielding plate 77*a*, the first upstream light-shielding plate 70*a*, the UV lamp 37*a*, the first downstream light-shielding plate 70*b*, and the second downstream light-shielding plate 77*b* remain in the positions facing the platen drum 30 even when the ejection head 36*a* and the ejection head 36*b* are move d to the maintenance position.

The maintenance section 5 includes a movable body 710 including the wiper 711, a cap 712, and a support member 713 that movably supports the wiper 711 and the cap 712 in an integrated manner, the drive motor that moves the movable body 710 in a wiping direction Dw including the conveyance direction Ds along the nozzle surface 39, a cleaning liquid supply pipe 730 that jets a cleaning liquid through jetting ports 730*a*, and a housing 740. Each of these members is formed to have a length in the +Y direction and the −Y direction to be equal to or more than the ejection head 36*b*, and hence is capable of performing maintenance to the entire nozzle surface 39. Moreover, the wiper 711 is moved in the wiping direction Dw while wiping surfaces 711*a* and 711*b* abut against the nozzle surface 39. With this, the wiping processing is performed. Further, the cap 712 is held in close contact with the nozzle surface 39 so as to cover all the nozzles, and hence capping is performed.

The cleaning liquid supply pipe 730 is open to the ejection head 36*b* side, includes the plurality of jetting ports 730*a* along the +Y direction and the −Y direction, and is capable of jetting the cleaning liquid to the side surface 59 being a supplied surface of the ejection head 36*b* on the cleaning liquid supply pipe 730 side when the ejection head 36*b* is at the cleaning position close to the maintenance section 5. As the cleaning liquid to be supplied to the wiping processing, a liquid having a suitable cleaning function may be used. When a UV ink is used as in the present exemplary embodiment, a solvent capable of dissolving a cured UV ink may be used. Examples of such solvent include Ethyl Di Glycol Acetate (EDGAC), a clear UV ink, and the like. Further, a cleaning liquid obtained by adding a surfactant or a polymerization inhibitor to such solvent may be used. Supply of the cleaning liquid from the cleaning liquid supply pipe 730 is configured to be switchable. Note that, the drive motor and the like are controlled by a control unit (not illustrated).

The housing 740 mainly includes a bottom surface 740*a* substantially parallel to the wiping direction Dw, a side wall 740*b* that stands vertically from one end of the bottom surface 740*a* in the wiping direction Dw, and an eave 740*c* that extends from an upper end of the side wall 740*b* along the wiping direction Dw in the same direction as the bottom surface 740*a*. The bottom surface 740*a* is provided in a range slightly larger than a range in which the movable body 710 is movable in the wiping direction Dw, and receives a waste liquid including the ink, the cleaning liquid, and the like, which is generated at the time of maintenance. The waste liquid received on the bottom surface 740*a* is discharged from the maintenance section 5 through a discharge port 740*d* formed in the bottom surface 740*a*. The eave 740*c* has a dimension in the wiping direction Dw, which is larger than the movable body 710. Further, during the printing operation, the movable body 710 maintains a state of being covered by the eave 740*c* at a standby position below the eave 740*c*. In this manner, the eave 740*c* blocks the UV light emitted from the UV lamps 37*a*, 37*b*, and 38, and prevents the UV ink adhering to the wiper 711 and the cap 712 from being cured.

Figure 5A:
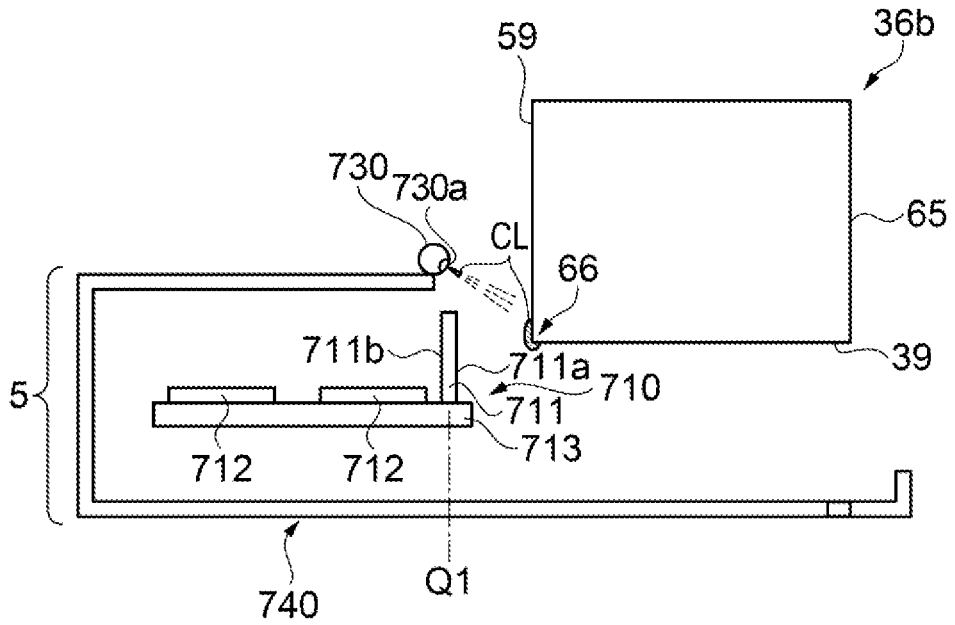
FIG. 5A is a schematic view illustrating an operation during wiping processing in the first exemplary embodiment.
Figure 5B:
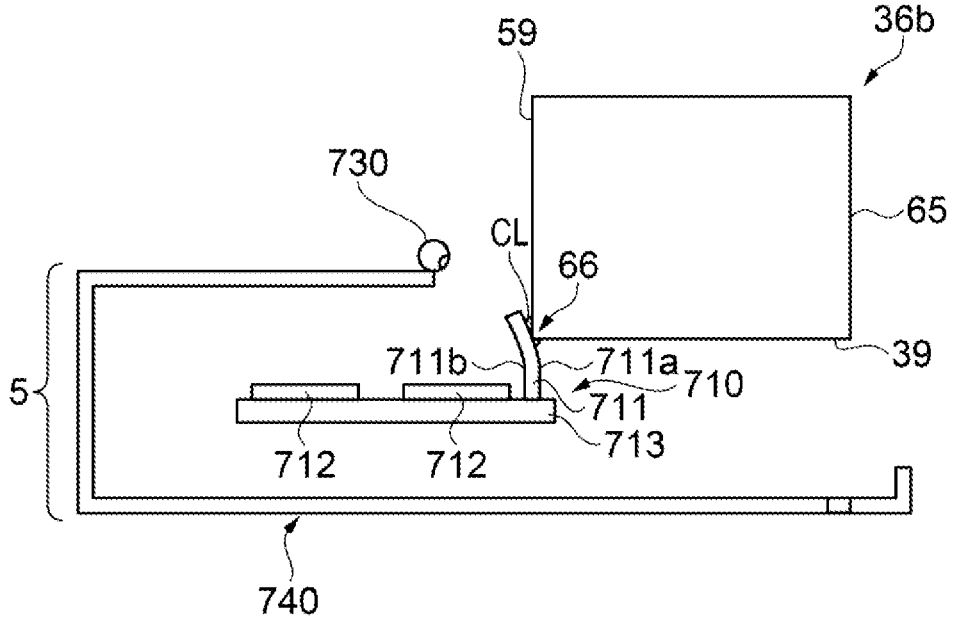
FIG. 5B is a schematic view illustrating the operation during the wiping processing in the first exemplary embodiment.
Figure 5C:
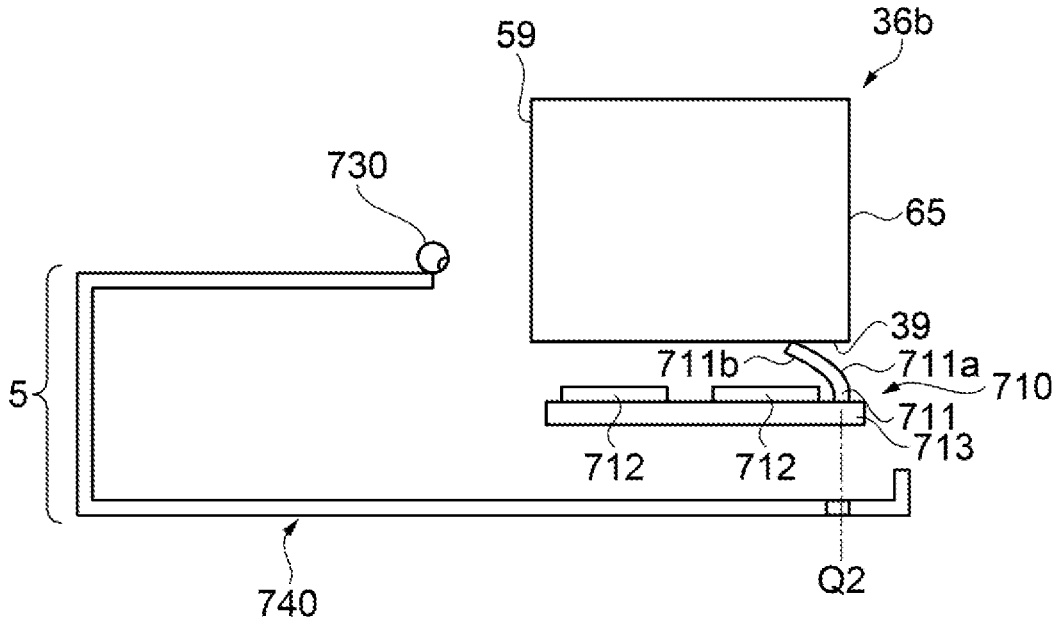
FIG. 5C is a schematic view illustrating the operation during the wiping processing in the first exemplary embodiment.

Next, an operation at the time of the wiping processing will be described. FIG. 5A to FIG. 5C are schematic views at the time of the wiping processing. In the wiping processing, after the cleaning liquid is jetted to the side surface 59 of the ejection head 36*a*, the wiper 711 is reciprocally moved a plurality of times in the wiping direction Dw. Note that, in the following description, a starting point Q1 in the reciprocatory movement of the wiper 711 and a terminal point Q2 at an end position on the opposite side are given.

As illustrated in FIG. 5A, the wiper 711 is moved to the starting point Q1. Further, the ejection head 36*b* is moved to the cleaning position. A state in which a distal end of the wiper 711 faces the side surface 59 of the ejection head 36*b*, in other words, a state in which the wiper 711 and the side surfaces 59 partially overlap with each other in the retreating direction Dh is obtained.

Subsequently, a cleaning liquid CL is jetted from the jetting ports 730*a* of the cleaning liquid supply pipe 730 to the side surface 59 of the ejection head 36*b*. The cleaning liquid jetted from the jetting ports 730*a* passes above the wiper 711, and lands on the side surface 59 without landing on the wiper 711. Then, when the cleaning liquid CL is jetted on the side surface 59, the cleaning liquid CL adhering to the side surfaces 59 flows downward along the side surface 59, and stagnates at a corner 66 between the side surface 59 and the nozzle surface 39.

Subsequently, the wiper 711 is moved from the starting point Q1 to the terminal point Q2, and performs wiping. During this process, as illustrated in FIG. 5B, the wiping surface 711*a* of the wiper 711 abuts against the corner 66, and the cleaning liquid CL stagnating at the corner 66 is retained by the wiper 711. Then, wiping is performed while the cleaning liquid CL retained by the wiper 711 is spread over the nozzle surface 39.

Here, for example, when ink mist generated at the time of ejecting the ink from the ejection head 36*b* adheres to the side surface 59 or receives reflected light or scattered light, the ink mist adhering to the side surface 59 is cured. When the wiping processing is performed in such a state, the ink cured on the side surface 59 is wiped off by the wiper 711 during the wiping processing. Then, the cured ink that is wiped off is conveyed to the nozzle surface 39 along with the movement of the wiper 711 and clogs the nozzles, which may cause an ejection defect. However, in the present exemplary embodiment, the second downstream light-shielding plate 77*b* is arranged, and hence the reflected light or the scattered light toward the side surface 59 of the ejection head 36*b* is blocked. With this, the ink mis adhering to the side surfaces 59 is not cured, is removed easily with the cleaning liquid CL during the wiping processing, and is prevented from clogging the nozzles due to the wiping processing.

FIG. 5C illustrates a state in which the wiper 711 is moved to the terminal point Q2. The terminal point Q2 in the reciprocatory movement of the wiper 711 is positioned below the ejection head 36*b*. The position of the terminal point Q2 is set below the ejection head 36*b* as described above for the following reason. When the wiper 711 is further moved rightward from a side surface 65 on the opposite side of the side surface 59, the wiping surface 711*b* of the wiper 711 abuts against the side surface 65 next time the wiper 711 is moved toward the starting point Q1. The cleaning liquid CL is not jetted on the side surface 65, and hence foreign matters such as the cured UV ink remains. When the wiper 711 abuts against the side surface 65, there may be a risk in that such foreign matters adhere to the wiper 711. In view of this, the position of the terminal point Q2 is set below the ejection head 36*b*. With this, abutment of the wiping surface 711*b* against the side surface 65 is prevented, and satisfactory wiping processing is achieved.

After that, the ejection head 36*b* is temporarily moved to the retracting position, and then is returned to the height of the cleaning position again. The ejection head 36*b* is temporarily moved to the retracting position as described above, which cancels a state in which the wiper 711 positioned at the terminal point Q2 is curved leftward. Further, the ejection head 36*b* is returned to the height of the cleaning position, the wiper 711 is curved rightward, and then the wiper 711 is moved from the terminal point Q2 to the starting point Q1. With this, the nozzle surface 39 is wiped.

According to the present exemplary embodiment described above, the following effects can be obtained.

In the printing apparatus 1, the housing 371 of the UV lamp 37*a* is arranged in the position far from the front surface 30*a* of the platen drum 30 with respect to the two planes, namely, the first virtual tangent plane P1 and the second virtual tangent plane P2. Thus, the first upstream light-shielding plate 70*a* and the first downstream light-shielding plate 70*b* can block the scattered light that is scattered by shining on the housing 371 near the irradiation port 373 of the UV lamp 37*a*, and can prevent part of the scattered light from the housing 371 from directly entering the nozzle surfaces 39 of the ejection heads 36*a* and 36*b*. Therefore, curing of ink adhering to the nozzle surfaces 39 of the ejection heads 36*a* and 36*b*, which is caused by part of the scattered light entering the nozzle surfaces 39 of the ejection heads 36*a* and 36*b*, can be prevented.

Further, the second upstream light-shielding plate 77*a* and the second downstream light-shielding plate 77*b* can block the reflected light or the scattered light on the side surfaces 59 of the ejection heads 36*a* and 36*b*. Therefore, curing of ink adhering to the side surfaces 59 of the ejection heads 36*a* and 36*b*, which is caused by part of the scattered light entering the side surfaces 59 of the ejection heads 36*a* and 36*b*, can be prevented.

In the manner described above, the liquid can be stably ejected from the ejection heads 36*a* and 36*b*.

2. Second Exemplary Embodiment

Figure 6:
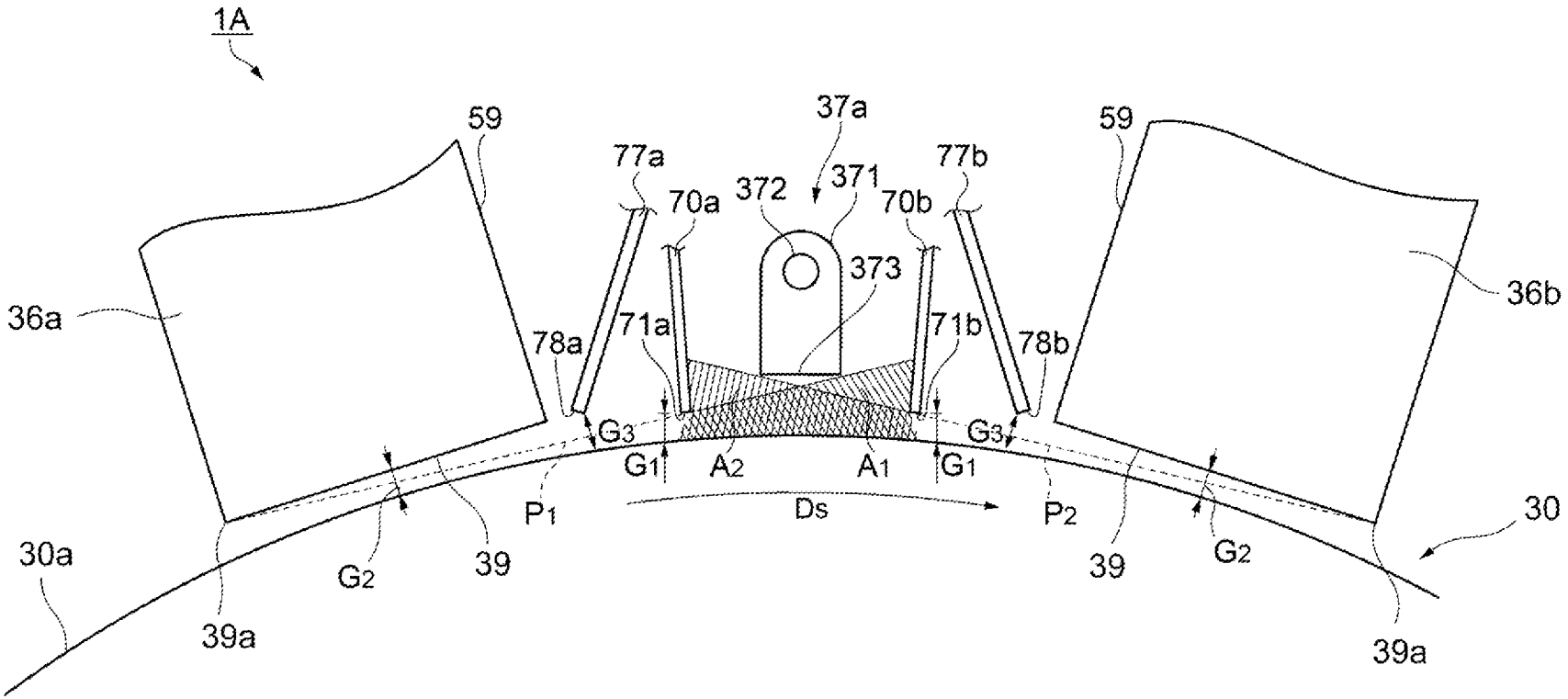
FIG. 6 is a schematic view partially illustrating a configuration of a printing apparatus according to a second exemplary embodiment.

Next, a second exemplary embodiment will be described. FIG. 6 is a schematic view partially illustrating a configuration of a printing apparatus 1A according to the present exemplary embodiment. Note that, an arrangement method of the second upstream light-shielding plate 77*a* and the second downstream light-shielding plate 77*b* in the printing apparatus 1A according to the present exemplary embodiment is different from the configuration in the first exemplary embodiment. Thus, the configuration other than the arrangement method of the second upstream light-shielding plate 77*a* and the second downstream light-shielding plate 77*b* is the same as the configuration of the first exemplary embodiment, and hence description therefor is omitted.

In the first exemplary embodiment, the second upstream light-shielding plate 77*a* and the second downstream light-shielding plate 77*b* are arrayed to face the side surfaces 59 of the ejection heads 36*a* and 36*b*. In the present exemplary embodiment, as illustrated in FIG. 6, the second upstream light-shielding plate 77*a* and the second downstream light-shielding plate 77*b* are arranged to be inclined with respect to the side surfaces 59 of the ejection heads 36*a* and 36*b*. Further, the second upstream light-shielding plate 77*a* and the second downstream light-shielding plate 77*b* in the present exemplary embodiment are arranged by being fixed to the frame for supporting the housing 371.

The second upstream light-shielding plate 77*a* is a plate-shaped member. Further, a surface of the second upstream light-shielding plate 77*a* on the downstream side in the conveyance direction Ds is arranged to be inclined while facing the curved surface 30*a*. Further, the second downstream light-shielding plate 77*b* is also a plate-shaped member. Further, a surface of the second downstream light-shielding plate 77*b* on the upstream in the conveyance direction Ds is arranged to be inclined while facing the curved surface 30*a*.

The second upstream light-shielding plate 77*a* and the second downstream light-shielding plate 77*b* are arranged in positions at which the gap G3 between each of the lower ends 78*a* and 78*b* of the second upstream light-shielding plate 77*a* and the second downstream light-shielding plate 77*b*, and the curved surface 30*a* is equal to or more than the height of the nozzle surfaces 39 from the curved surface 30*a* (the gap G2). In the present exemplary embodiment, the gap G3 between each of the second upstream light-shielding plate 77*a* and the second downstream light-shielding plate 77*b*, and the curved surface 30*a* of the platen drum 30, (the gap G3) is the same as the gap G2 between the nozzle surface 39 of the ejection head 36*a* and the curved surface 30*a* of the platen drum 30 (the gap G2). With this, while preventing the second upstream light-shielding plate 77*a* and the second downstream light-shielding plate 77*b* from being held in contact with the sheet S supported by the curved surface 30*a* of the platen drum 30, the reflected light or the scattered light can be prevented from entering the side surfaces 59 of the ejection heads 36*a* and 36*b* as much as possible. Therefore, curing of ink adhering to the side surfaces 59 of the ejection heads 36*a* and 36*b*, which is caused by part of the scattered light entering the side surfaces 59 of the ejection heads 36*a* and 36*b*, can be prevented.

According to the present exemplary embodiment described above, the following effects can be obtained in addition to the effects described above.

The second upstream light-shielding plate 77*a* and the second downstream light-shielding plate 77*b* are arranged to be inclined. Thus, outer shapes of the second upstream light-shielding plate 77*a* and the second downstream light-shielding plate 77*b* can be relatively small, and hence space reduction can be achieved.

3. Third Exemplary Embodiment

Figure 7:
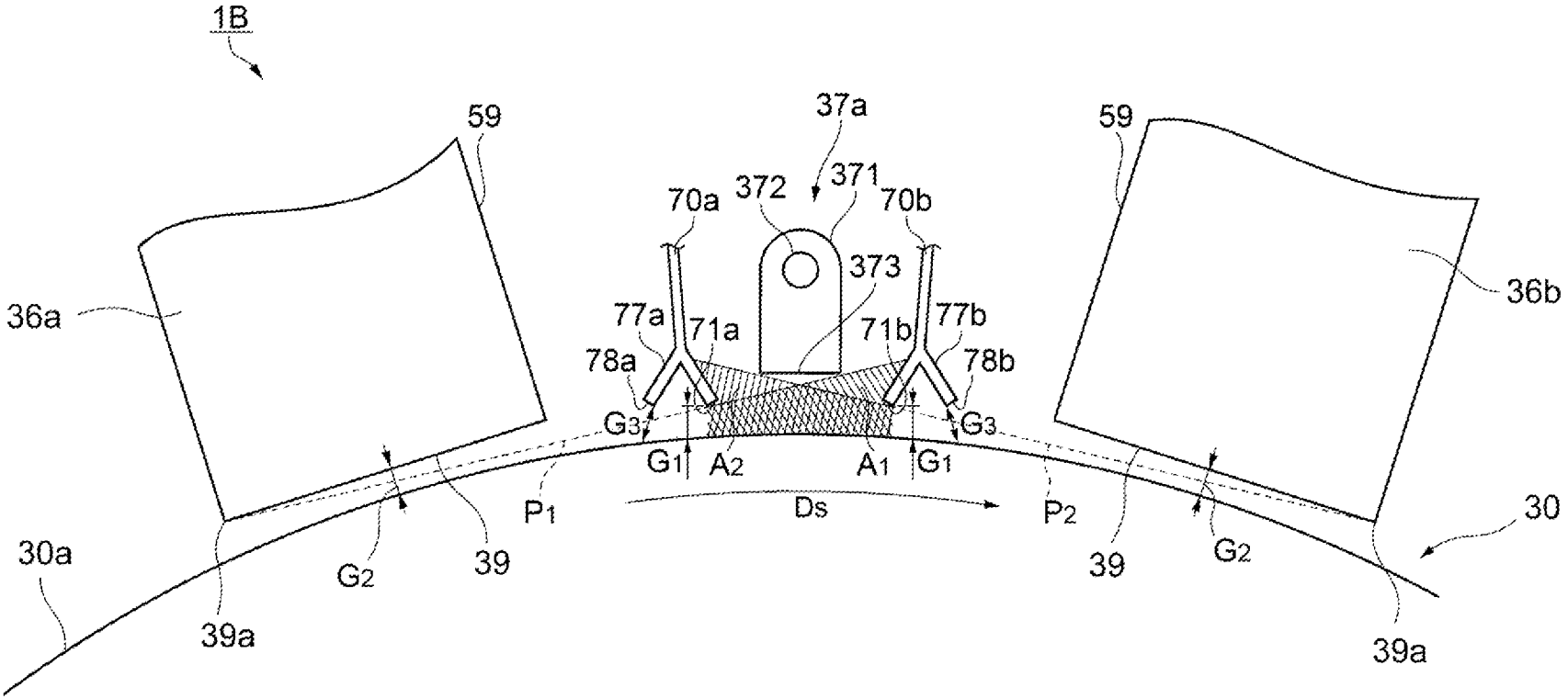
FIG. 7 is a schematic view partially illustrating a configuration of a printing apparatus according to a third exemplary embodiment.

Next, a third exemplary embodiment will be described. FIG. 7 is a schematic view partially illustrating a configuration of a printing apparatus 1B according to the present exemplary embodiment.

Note that, the arrangement method of the second upstream light-shielding plate 77*a* and the second downstream light-shielding plate 77*b* in the printing apparatus 1B according to the present exemplary embodiment is different from the configuration of the first exemplary embodiment. Thus, the configuration other than the arrangement method of the second upstream light-shielding plate 77*a* and the second downstream light-shielding plate 77*b* is the same as the configuration of the first exemplary embodiment, and hence description therefor is omitted.

As illustrated in FIG. 7, the second upstream light-shielding plate 77*a* and the first upstream light-shielding plate 70*a* are integrally formed. Specifically, the second upstream light-shielding plate 77*a* in an inclined state is integrated with the first upstream light-shielding plate 70*a*. More specifically, the second upstream light-shielding plate 77*a* is a plate-shaped member, the surface of the second upstream light-shielding plate 77*a* on the downstream side in the conveyance direction Ds, which is inclined while facing the curved surface 30*a*, is integrated with the first upstream light-shielding plate 70*a*.

Similarly, the second downstream light-shielding plate 77*b* and the first downstream light-shielding plate 70*b* are integrally formed. Specifically, the second downstream light-shielding plate 77*b* in an inclined state is integrated with the first downstream light-shielding plate 70*b*. More specifically, the second downstream light-shielding plate 77*b* is a plate-shaped member, and the surface of the second downstream light-shielding plate 77*b* on the upstream in the conveyance direction Ds, which is inclined while facing the curved surface 30*a*, is integrated with the first downstream light-shielding plate 70*b*.

Note that, the second upstream light-shielding plate 77*a* and the second downstream light-shielding plate 77*b* are arranged in positions at which the gap G3 between each of the lower ends 78*a* and 78*b* of the second upstream light-shielding plate 77*a* and the second downstream light-shielding plate 77*b*, and the curved surface 30*a* is equal to or more than the height of the nozzle surfaces 39 from the curved surface 30*a* (the gap G2). In the present exemplary embodiment, the gap G3 between each of the second upstream light-shielding plate 77*a* and the second downstream light-shielding plate 77*b*, and the curved surface 30*a* of the platen drum 30, (the gap G3) is the same as the gap G2 between the ejection head 36*a* and the curved surface 30*a* of the platen drum 30 (the gap G2). With this, while preventing the second upstream light-shielding plate 77*a* and the second downstream light-shielding plate 77*b* from being held in contact with the sheet S supported by the curved surface 30*a* of the platen drum 30, the reflected light or the scattered light can be prevented from entering the side surfaces 59 of the ejection heads 36*a* and 36*b* as much as possible. Therefore, curing of ink adhering to the side surfaces 59 of the ejection heads 36*a* and 36*b*, which is caused by part of the scattered light entering the side surfaces 59 of the ejection heads 36*a* and 36*b*, can be prevented.

Further, as illustrated in FIG. 7, folding may be performed so that a part of the first upstream light-shielding plate 70*a* in a direction of the lower end 71*a* is inclined to the downstream side in the conveyance direction Ds. Similarly, folding may be performed so that a part of the first downstream light-shielding plate 70*b* in a direction of the lower end 71*b* is inclined to the upstream in the conveyance direction Ds.

According to the present exemplary embodiment described above, the following effects can be obtained in addition to the effects described above.

The second upstream light-shielding plate 77*a* and the first upstream light-shielding plate 70*a*, and the second downstream light-shielding plate 77*b* and the first downstream light-shielding plate 70*b*, which are integrally formed, are easily mounted.

4. Modification Example

Note that, the present disclosure is not limited to the exemplary embodiments described above, and various modifications and improvements can be added to the above-described exemplary embodiments. Modification examples will be given below.

Modification Example 1

In the exemplary embodiments, the configuration in which the ejection heads 36*a* and 36*b* are arranged on the upstream and the downstream side of the UV lamp 37*a*, respectively, is described. However, the exemplary embodiments are not limited thereto. For example, a configuration in which, for example, the ejection head 36*a* is arranged only on any one of the upstream and the downstream side of the UV lamp 37*a* may be adopted. Further, the first upstream light-shielding plate 70*a* being a first light-shielding plate is arranged between the ejection head 36*a* and the UV lamp 37*a* in the conveyance direction Ds. Further, the second upstream light-shielding plate 77*a* being a second light-shielding plate is arranged between the first upstream light-shielding plate 70*a* and the ejection head 36*a*. Even with such a configuration, effects similar to those described above can be obtained.

Modification Example 2

In the exemplary embodiments, description is made on the printing apparatus 1 of a so-called drum type using the platen drum 30. The disclosure is also applicable to a printing apparatus 1C different from the drum-type printing apparatus 1.

Figure 8:
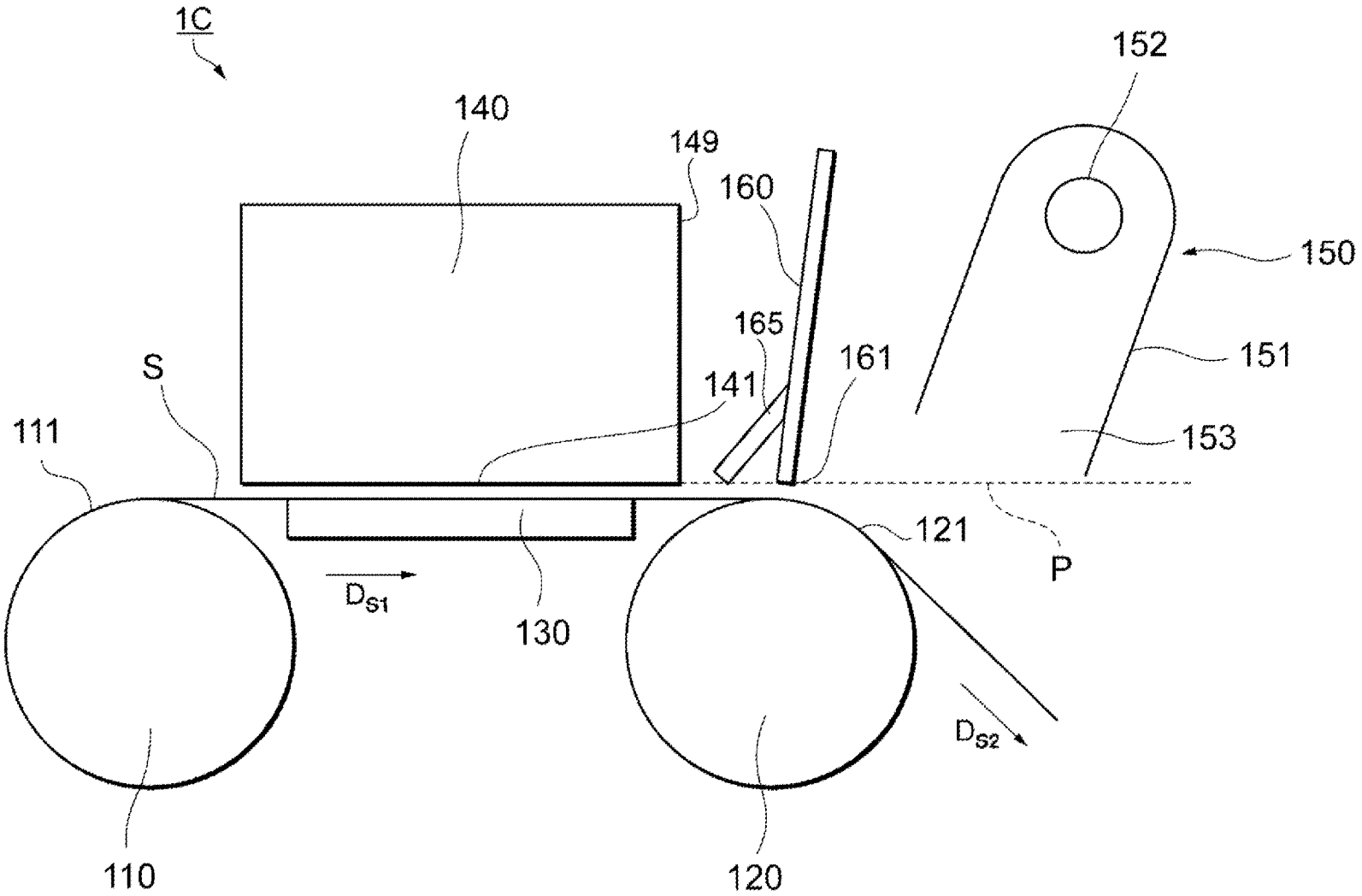
FIG. 8 is a schematic view partially illustrating a configuration of a printing apparatus in a modification example.

FIG. 8 is a schematic view partially illustrating a configuration of the printing apparatus 1C in the modification example. As illustrated in FIG. 8, in the printing apparatus 1C, a sheet S is conveyed in a first conveyance direction DS1 while being supported by a front surface 111 of a front roller 110, a front surface (curved surface) 121 of a rear roller 120 (support member), and a guide 130 having a flat support surface, a nozzle of a nozzle surface 141 of an ejection head 140 ejects a UV ink onto a front surface of the sheet S. In this manner, an image is printed. The front surface 121 of the rear roller 120 changes the conveyance direction of the sheet S to a second conveyance direction DS2, a UV lamp (irradiation section) 150 including a housing 151 and a light emitting section 152 is arranged downstream of the rear roller 120, and a first light-shielding plate 160 is arranged between the ejection head 140 and the UV lamp 150. In the printing apparatus 1C, light scattered by shining on the housing 151 of the UV lamp 150 near an irradiation port 153 of the UV lamp 150 may enter the nozzle surface 141 of the ejection head 140 depending on a position of the UV lamp 150.

Thus, in the printing apparatus 1C having such a configuration, the housing 151 of the UV lamp 150 is arranged in a position far from the front surface 121 of the rear roller 120 with respect to a virtual tangent plane P that passes through a portion of the nozzle surface 141 of the ejection head 140 being farthest from the irradiation port 153 of the UV lamp 150 and that is held in contact with a lower end 161 of the first light-shielding plate 160. In this manner, when the housing 151 of the UV lamp 150 is arranged in the position far from the front surface 121 of the rear roller 120 with respect to the virtual tangent plane P, the first light-shielding plate 160 can block all light scattered by shining on the housing 151 of the UV lamp 150 near the irradiation port 153 of the UV lamp 150, and can prevent part of the scattered light from the housing 151 from entering the nozzle surface 141 of the ejection head 140.

Further, in the conveyance directions DS1 and DS2, a second light-shielding plate 165 is arranged between the first light-shielding plate 160 and the ejection head 140. The configuration of the second light-shielding plate 165 is the same as the configuration of the second upstream light-shielding plate 77*a* in the exemplary embodiments. In this manner, the second light-shielding plate 165 can block reflected light or scattered light on the side surface 149 of the ejection head 140. Therefore, curing of ink adhering to the side surface 149 of the ejection head 140, which is caused by part of the scattered light entering the side surface 149 of the ejection head 140, can be prevented.

Contents derived from the exemplary embodiments will be described below.

A printing apparatus includes a support member configured to support, with a curved surface thereof, a recording medium conveyed in a predetermined conveyance direction, an ejection head configured to eject a liquid from a nozzle of a nozzle surface arranged at a position facing the support member to print an image on the recording medium supported by the curved surface, an irradiation section including a housing and a light emitting section configured to emit light for curing the liquid, the light emitting section accommodated inside the housing, the irradiation section configured to irradiate the recording medium supported by the curved surface with the light emitted from the light emitting section through an irradiation port defined by the housing, a first light-shielding plate arranged between the ejection head and the irradiation section in the conveyance direction, and a second light-shielding plate arranged between the first light-shielding plate and the ejection head in the conveyance direction, wherein the housing is arranged in a position far from the curved surface with respect to a virtual tangent plane that passes through a portion of the nozzle surface being farthest from the irradiation port and is held in contact with a lower end of the first light-shielding plate, and the second light-shielding plate is arranged in a position capable of blocking at least part of light entering a side surface orthogonal to the nozzle surface of the ejection head among the light that is emitted from the irradiation section and regularly reflected or scattered on the support member or the recording medium supported by the support member, and is arranged in a position so that a distance between a lower end of the second light-shielding plate and the curved surface is equal to or more than a height of the nozzle surface from the curved surface.

With this configuration, the housing of the irradiation section is arranged in the position far from the curved surface of the support member supporting the recording medium with respect to the virtual tangent plane that passes through the portion of the nozzle surface of the ejection head being farthest from the irradiation port of the irradiation section and is held in contact with the lower end of the first light-shielding plate. Thus, the first light-shielding plate can block almost all the scattered light near the irradiation port, and part of the scattered light can be prevented from entering the nozzle surface of the ejection head. Therefore, curing of ink adhering to the nozzle surface, which is caused by part of the scattered light entering the nozzle surface of the ejection head, can be prevented.

Further, the second light-shielding plate can block the reflected light or the scattered light on the side surface of the ejection head. Therefore, curing of ink adhering to the side surface of the ejection head, which is caused by part of the scattered light entering the side surface of the ejection head, can be prevented.

In the manner described above, the liquid can be stably ejected from the ejection head.

In the printing apparatus, an interval between the second light-shielding plate and the curved surface may be the same as an interval between the ejection head and the curved surface.

With this configuration, while preventing the second light-shielding plates from being held in contact with the recording medium supported by the curved surface of the support member, the reflected light or the scattered light can be prevented from entering the side surfaces of the ejection heads as much as possible.

In the printing apparatus, the first light-shielding plate and the second light-shielding plate may be integrally formed.

With this configuration, the first light-shielding plate and the second light-shielding plate are easily mounted.

In the printing apparatus, the ejection head may be a first ejection head arranged upstream of the irradiation section in the conveyance direction, the first light-shielding plate may be a first upstream light-shielding plate arranged upstream of the irradiation section in the conveyance direction, the second light-shielding plate may be a second upstream light-shielding plate arranged upstream of the first upstream light-shielding plate in the conveyance direction, the virtual tangent plane may be a first virtual tangent plane that passes through a position of the nozzle surface of the first ejection head being farthest from the irradiation port and is held in contact with a lower end of the first light-shielding plate, the printing apparatus may further include a first downstream light-shielding plate arranged downstream of the irradiation section in the conveyance direction, a second ejection head arranged downstream of the first downstream light-shielding plate in the conveyance direction, and a second downstream light-shielding plate arranged between the first downstream light-shielding plate and the second ejection head in the conveyance direction, the housing may be arranged in a position far from the curved surface with respect to a second virtual tangent plane that passes through a portion, farthest from the irradiation port, of the nozzle surface of the second ejection head and is held in contact with a lower end of the first downstream light-shielding plate, and the second downstream light-shielding plate may be arranged in a position capable of blocking at least part of light entering a side surface orthogonal to the nozzle surface of the second ejection head among the light that is emitted from the irradiation section and regularly reflected or scattered, and is arranged in a position so that a distance between a lower end of the second downstream light-shielding plate and the curved surface is equal to or more than a height of the nozzle surface from the curved surface.

With this configuration, the housing of the irradiation section is arranged in the position far from the curved surface of the support member supporting the recording medium with respect to the two virtual tangent planes (the first virtual tangent plane located upstream of the irradiation section and the second virtual target plane located downstream of the irradiation section). Thus, the first upstream light-shielding plate and the first downstream light-shielding plate can block almost all the scattered light near the irradiation port, and part of the scattered light can be prevented from entering the nozzle surfaces of the first ejection head and the second ejection head. Therefore, curing of ink adhering to the nozzle surfaces, which is caused by part of the scattered light entering the nozzle surfaces of the first ejection head and the second ejection head, can be prevented.

Further, the second upstream light-shielding plate and the second downstream light-shielding plate can block the reflected light or the scattered light on the side surfaces of the first ejection head and the second ejection head. Therefore, curing of ink adhering to the side surfaces of the first ejection head and the second ejection head, which is caused by part of the scattered light entering the side surfaces of the first ejection head and the second ejection head, can be prevented. Therefore, for example, even when the ejection heads are wiped during maintenance of the first ejection head and the second ejection head, the liquid adhering to the side surfaces of the first ejection head and the second ejection head can be removed easily.

In the manner described above, the liquid can be stably ejected from the first ejection head and the second ejection head.

What is claimed is:

1. A printing apparatus: comprising:

a support member configured to support, with a curved surface thereof, a recording medium conveyed in a predetermined conveyance direction;

an ejection head configured to eject a liquid from a nozzle of a nozzle surface arranged at a position facing the support member, to print an image on the recording medium supported by the curved surface;

an irradiation section including:

a housing; and a light emitting section configured to emit light for curing the liquid, the light emitting section being accommodated inside the housing, the irradiation section configured to irradiate the recording medium supported by the curved surface with the light emitted from the light emitting section through an irradiation port defined by the housing;

a first light-shielding plate arranged between the ejection head and the irradiation section in the conveyance direction; and a second light-shielding plate arranged between the first light-shielding plate and the ejection head in the conveyance direction, wherein the housing is arranged in a position far from the curved surface with respect to a virtual tangent plane that passes through a portion, farthest from the irradiation port, of the nozzle surface and is in contact with a lower end of the first light-shielding plate, and the second light-shielding plate is arranged in a position that allows the second light-shielding plate to block at least part of light, entering a side surface orthogonal to the nozzle surface of the ejection head, of the light that is emitted from the irradiation section and regularly reflected or scattered by the support member or the recording medium supported by the support member, and is arranged in a position so that a distance between a lower end of the second light-shielding plate and the curved surface is equal to or larger than a height of the nozzle surface from the curved surface.

2. The printing apparatus according to claim 1, wherein an interval between the second light-shielding plate and the curved surface is the same as an interval between the ejection head and the curved surface.

3. The printing apparatus according to claim 1, wherein the first light-shielding plate and the second light-shielding plate are integrally formed.

4. The printing apparatus according to claim 1, wherein the ejection head is a first ejection head arranged upstream of the irradiation section in the conveyance direction, the first light-shielding plate is a first upstream light-shielding plate arranged upstream of the irradiation section in the conveyance direction, the second light-shielding plate is a second upstream light-shielding plate arranged upstream of the first upstream light-shielding plate in the conveyance direction, the virtual tangent plane is a first virtual tangent plane that passes through a position, farthest from the irradiation port, of the nozzle surface of the first ejection head and is in contact with a lower end of the first light-shielding plate, the printing apparatus further comprises:

a first downstream light-shielding plate arranged downstream of the irradiation section in the conveyance direction;

a second ejection head arranged downstream of the first downstream light-shielding plate in the conveyance direction; and a second downstream light-shielding plate arranged between the first downstream light-shielding plate and the second ejection head in the conveyance direction, the housing is arranged in a position far from the curved surface with respect to a second virtual tangent plane that passes through a portion, farthest from the irradiation port, of the nozzle surface of the second ejection head and is in contact with a lower end of the first downstream light-shielding plate, and the second downstream light-shielding plate is arranged in a position that allows the second light-shielding plate to block at least part of light, entering a side surface orthogonal to the nozzle surface of the second ejection head, of the light that is regularly reflected or scattered, and is arranged in a position so that a distance between a lower end of the second downstream light-shielding plate and the curved surface is equal to or larger than a height of the nozzle surface from the curved surface.

* * * * *